US007731061B1

(12) United States Patent
Woodhouse et al.

(10) Patent No.: US 7,731,061 B1
(45) Date of Patent: Jun. 8, 2010

(54) WEARABLE TOY WITH ROTATABLE DISCHARGE PODS FOR FIRING PROJECTILES AND METHODS

(75) Inventors: Hampton R Woodhouse, Hope, RI (US); Alric J Lam, Attleboro, MA (US)

(73) Assignee: Hasbro, Inc., Pawtucket, RI (US)

( * ) Notice: Subject to any disclaimer, the term of this patent is extended or adjusted under 35 U.S.C. 154(b) by 658 days.

(21) Appl. No.: 11/744,272

(22) Filed: May 4, 2007

(51) Int. Cl.
*B67D 99/00* (2010.01)

(52) U.S. Cl. ..... 222/175; 222/78; 222/79; 124/56; 446/26; 446/473; 446/483

(58) Field of Classification Search ..... 124/56; 222/78, 79, 175, 333; 239/152, 153, 154; 446/26, 27, 28, 473, 475, 483; 2/160, 163; 42/54

See application file for complete search history.

(56) References Cited

U.S. PATENT DOCUMENTS 2,423,448 A * 7/1947 Haight ..... 42/13
3,018,578 A * 1/1962 Hill ..... 42/13
3,453,774 A * 7/1969 Gruber et al. ..... 446/353
4,756,703 A 7/1988 Kennedy et al.
4,768,681 A * 9/1988 Dean et al. ..... 222/79
4,820,229 A 4/1989 Spraggins
5,072,856 A 12/1991 Kimble
5,088,624 A * 2/1992 Hackett et al. ..... 222/78
5,316,514 A 5/1994 Ellman et al.
5,538,457 A 7/1996 Deal
5,673,436 A * 10/1997 Piper ..... 2/160
5,678,730 A * 10/1997 Fabek et al. ..... 222/78
5,724,955 A * 3/1998 Johnson et al. ..... 124/72
6,203,397 B1 3/2001 Applewhite et al.
6,279,562 B1 8/2001 Clayton
RE37,616 E 4/2002 Schumacher
6,802,435 B1 * 10/2004 Brawner, Jr. ..... 222/79
6,814,260 B2 11/2004 Caffrey
6,824,442 B2 11/2004 Andrews et al.

* cited by examiner

*Primary Examiner*—Troy Chambers
(74) *Attorney, Agent, or Firm*—Perry Hoffman

(57) ABSTRACT

A wearable toy having an outer housing capable of rotating around a wearable component with more than one pod at the outer housing each able to receive a contained discharge element. The pods are engaged by an actuator assembly which operates to project the contained discharge element of each pod. The pods at the outer housing may receive, e.g., a removable canister containing the discharge elements. The actuator assembly includes a first actuator coupled to the wearable component for manipulation by a user and a second actuator capable of engaging the first actuator projecting the contained discharge element of each of the plurality of pods. The canister may include a second actuator coupled and capable of engagement with the first actuator as the outer housing member is rotated to allow alignment of first and second actuators for projecting the contained discharge element.

20 Claims, 10 Drawing Sheets

WEARABLE TOY WITH ROTATABLE DISCHARGE PODS FOR FIRING PROJECTILES AND METHODS

BACKGROUND OF THE INVENTION

1. Field of the Invention

The present invention relates to toys and more particularly to a wearable toy with a plurality of discharge pods capable of rotating about the toy for launching of a variety of projectiles and other discharge elements by simply pressing a single lever one or more times. The invention also relates to a method for projecting a discharge element from a plurality of rotating pods though the pumping and triggering action of the toy of the present invention.

2. Background of the Invention

Many kinds of shooting toys exist and are designed for the amusement of children and adults alike. Shooting toys come in various shapes with some of the most common toys shaped like guns of all sizes. Various other known shooting devices exist and include configurations which squirt water from reservoirs and discharge numerous projectiles from multiple chambers.

Water guns in the shape of hand guns, rifles, machine guns, and other configurations have been the most common type of toy utilizing water as a projectile. These configurations can be simple hand-held squirt guns that use trigger-activated pumps to eject water, or more complicated and sophisticated shooters that rely upon pressurized tanks to shoot a stream of water a significant distance.

Concealed water guns add an extra dimension of fun in water fights and allow a user to move very close to their intended target before shooting the water. As a result many gun configurations have allowed a user to squirt water from various reservoirs often hidden on the body of the user. Some of these configurations have relied upon an electric pumps activated by a switch to eject water from a nozzle, as well as configurations which include a pressurized bladder plumbed to a trigger-operated nozzle mounted on a wrist of a user, or worn around a user's waist.

Other known projectile discharge devices include held or worn devices which are capable of shooting numerous projectiles. Some of these devices are shaped like guns employing a variety of discharge ports and a distribution mechanism to conduct the pressurized gas or liquid to the discharge ports in order to eject solid projectiles or liquid and gas. Other known devices are worn on the back of the hand of the user and employ a plurality of chambers capable of receiving numerous projectiles which are deployed by pulling each one of the multiple triggers linked to each one of the plurality of chambers.

Significantly, known shooting toys do not include a wearable toy with a plurality of rotatable discharge pods launching of a variety of projectiles with the activation of a single lever. It would be desirable to provide a mechanism with the triggering action capable of projecting a discharge element from a plurality of rotating pods.

SUMMARY OF THE INVENTION

The present invention addresses shortcomings of the prior art to provide a toy capable of projecting a discharge element from a variety of rotatable pods through a quick and fun triggering action. An actuator assembly engages with each of the plurality of rotatable pods for projecting a discharge element by depressing a single lever one or more times. The actuator assembly includes a first actuator for manipulation by a user and a second actuator capable of engaging the first actuator and operational with a variety of contained discharge elements. The actuator assembly is capable of projecting the contained discharge element, rotating multiple projectiles of a contained discharge element into firing position, and pressurizing a contained fluid discharge element for firing of the fluid, through the same activation of the first actuator manipulated by the user.

In one embodiment of the invention, the toy includes a wearable component and an outer housing member rotatable about the wearable component. A plurality of pods at the outer housing member is each capable of receiving a discharge element contained therewith and an actuator assembly engages with each of the plurality of pods for projecting the contained discharge element.

In another embodiment of the invention, the actuator assembly includes a first actuator coupled to the wearable component for manipulation by a user and a second actuator capable of engaging the first actuator for projecting the contained discharge element. In yet another embodiment, the discharge element includes one or more of the following: a fluid; a projectile; and a light emitting element.

In another embodiment of the invention, the wearable component includes a wearable cylinder, and in still another embodiment a covering worn by the user is further included to facilitate the alignment of the cylinder on the forearm of the user.

In another embodiment, the toy includes a removable canister to contain the discharge element received in at least one of the plurality of pods, and in a further embodiment, the second actuator is coupled to the removable canister and capable of engagement with the first actuator as the outer housing member is rotated to allow alignment of first and second actuators for projecting the discharge element contained in the canister.

In yet another embodiment, the outer housing member is manually rotatable about the wearable component, and in still another embodiment, the toy further includes a motor to drive the rotation of the outer housing member about the wearable component, and the first actuator projects the contained discharge element within each of the plurality of pods and rotates the outer housing member.

In another embodiment of the invention, a method for projecting a discharge element from a plurality of pods includes providing a wearable component, rotatably coupling an outer housing member to the wearable component and affixing a plurality of pods to the outer housing. Containing a discharge element within each of the plurality of pods and activating an actuator assembly capable of engaging each of the plurality of pods projects the contained discharge element.

In another embodiment, the actuator assembly further provides a first actuator coupled to the wearable component for manipulation by a user and a second actuator capable of engaging the first actuator for projecting the contained discharge element, and in another embodiment the wearable component further provides a wearable cylinder.

In yet another embodiment, the discharge element includes one or more of the following: a fluid; a projectile; and a light emitting element, and in still another embodiment, the discharge element is contained in a removable canister received in at least one of the plurality of pods.

Briefly summarized, the present invention relates to a wearable toy having an outer housing capable of rotating around a wearable component and more than one pod at the outer housing each able to receive a contained discharge element. The pods are engaged by an actuator assembly which operates to project the contained discharge element of each pod.

BRIEF DESCRIPTION OF THE DRAWINGS

For the purpose of facilitating an understanding of the inventions, the accompanying drawings and description illustrate a preferred embodiment thereof, from which the inventions, structure, construction and operation, and many related advantages may be readily understood and appreciated.

DETAILED DESCRIPTION OF THE PREFERRED EMBODIMENT

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

Figure 1A:
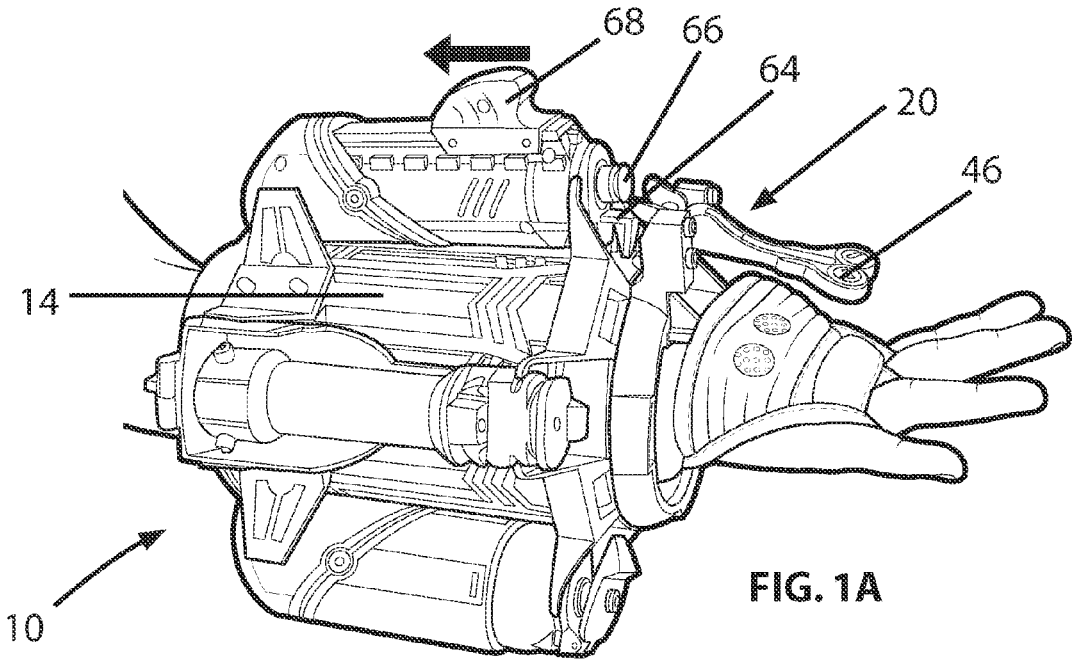
FIG. 1A is a perspective view of a toy of the present invention shown on a user and illustrating the actuator assembly in a non-firing position, with FIG. 1B illustrating the actuator assembly in a firing position.
Figure 1B:
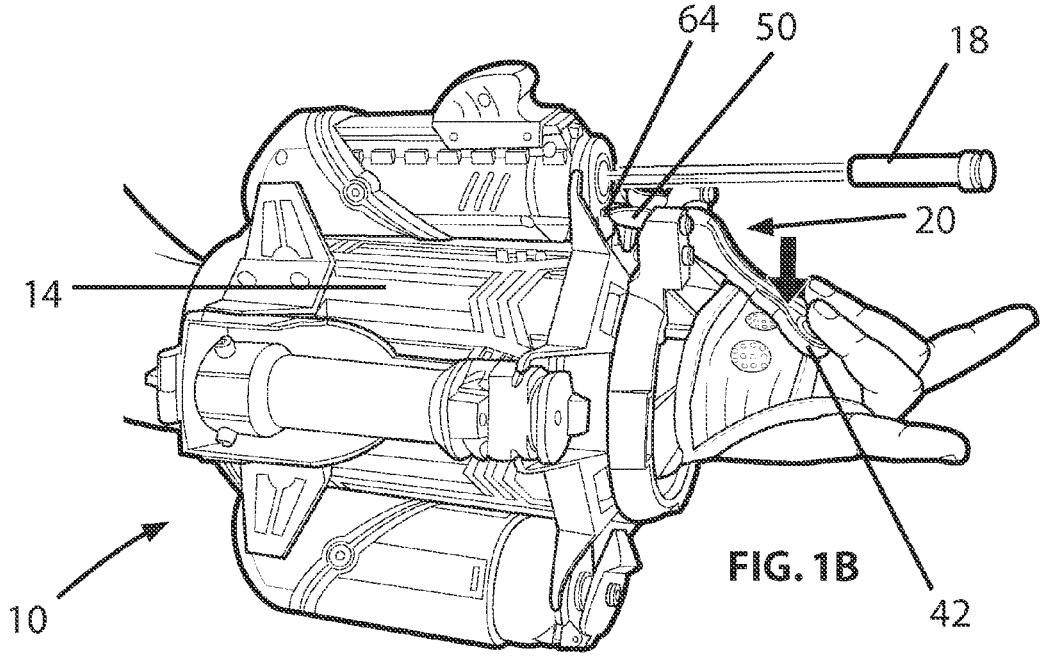

A toy 10, as seen in FIGS. 1A and 1B is generally wearable and includes a plurality of discharge pods capable of rotating about the toy for launching a variety of projectiles through the triggering action of the actuator assembly. In the present described embodiment, the toy 10 is wearable on the forearm of a user and is shown in the non-firing position in FIG. 1A and in the firing position in FIG. 1B.

Figure 2:
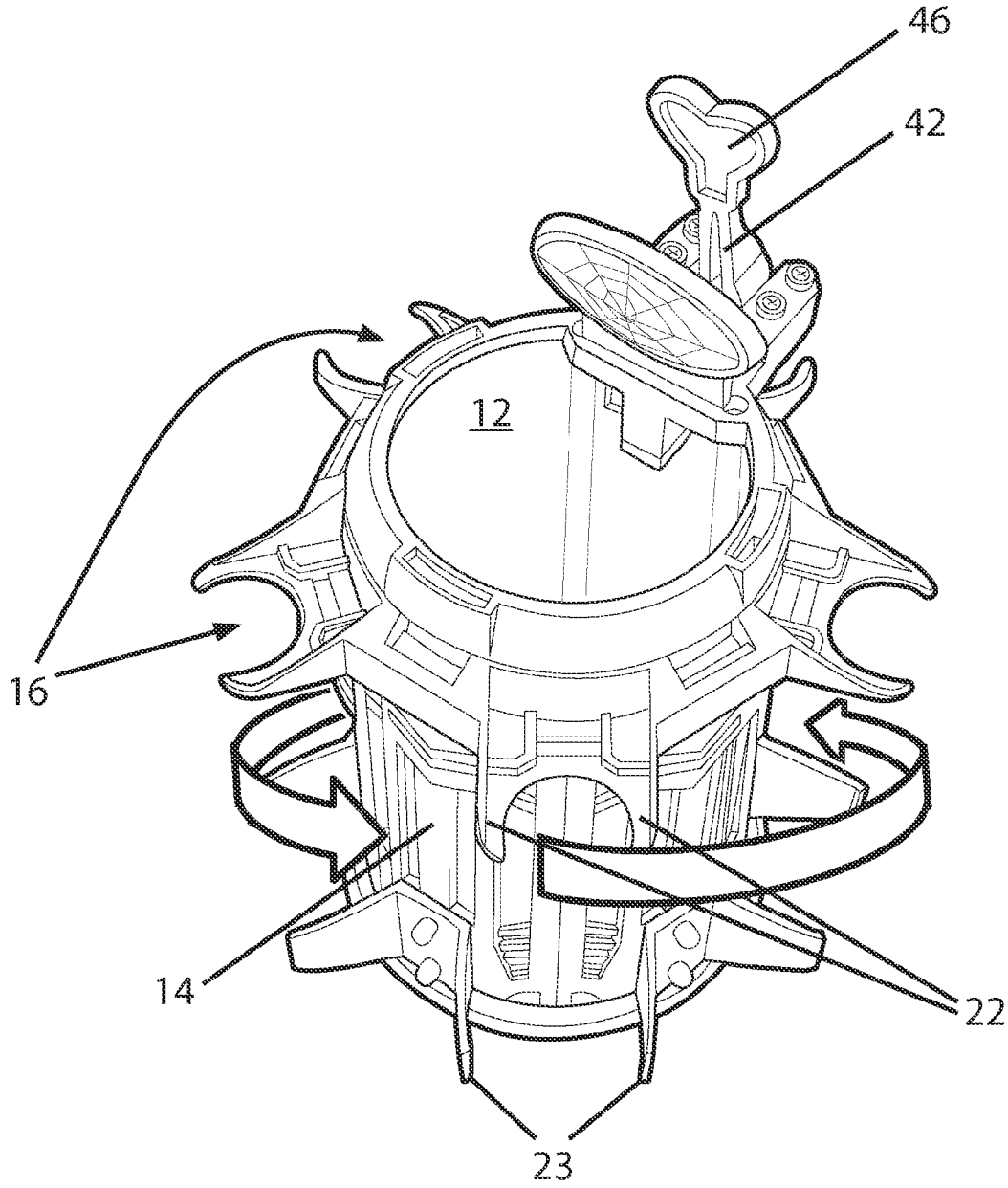
FIG. 2 illustrates the wearable component and outer housing member rotatably coupled together.

A wearable component 12, as seen in FIG. 2, includes a wearable cylinder in the present described embodiment allowing the wearable component 12 to be slipped onto the forearm of the user. An outer housing member 14 is coupled to the wearable component 12 such that the housing 14 can be rotated about the wearable component 12, as seen in FIG. 2. A plurality of pods 16 at the outer housing are each capable of receiving a discharge element 18 contained therewith, and an actuator assembly 20, as seen in FIG. 1B, engages each of the plurality of pods 16 for projecting the contained discharge element 18.

The wearable component 12 and the outer housing member 14 are generally comprised of a durable plastic material but can include any variety of materials which are durable and generally lightweight so as be comfortable when worn by the user. The outer housing member 14, as seen in FIGS. 2 and 3 includes a plurality of slightly curved projections 22 forming multiple holding clips 25, and a plurality of mostly straight projections 23 which together form the plurality of pods 16 at the outer housing 14. In the present described embodiment, as seen in FIG. 3, the combination of the holding clip 25 at a first end 24 of the housing member 14 and two mostly straight projections 22 disposed slightly apart from one another at a second end 26 of the housing member 14 form the pod 16 for receiving the contained discharge element 18.

Figures 3A, 3B:
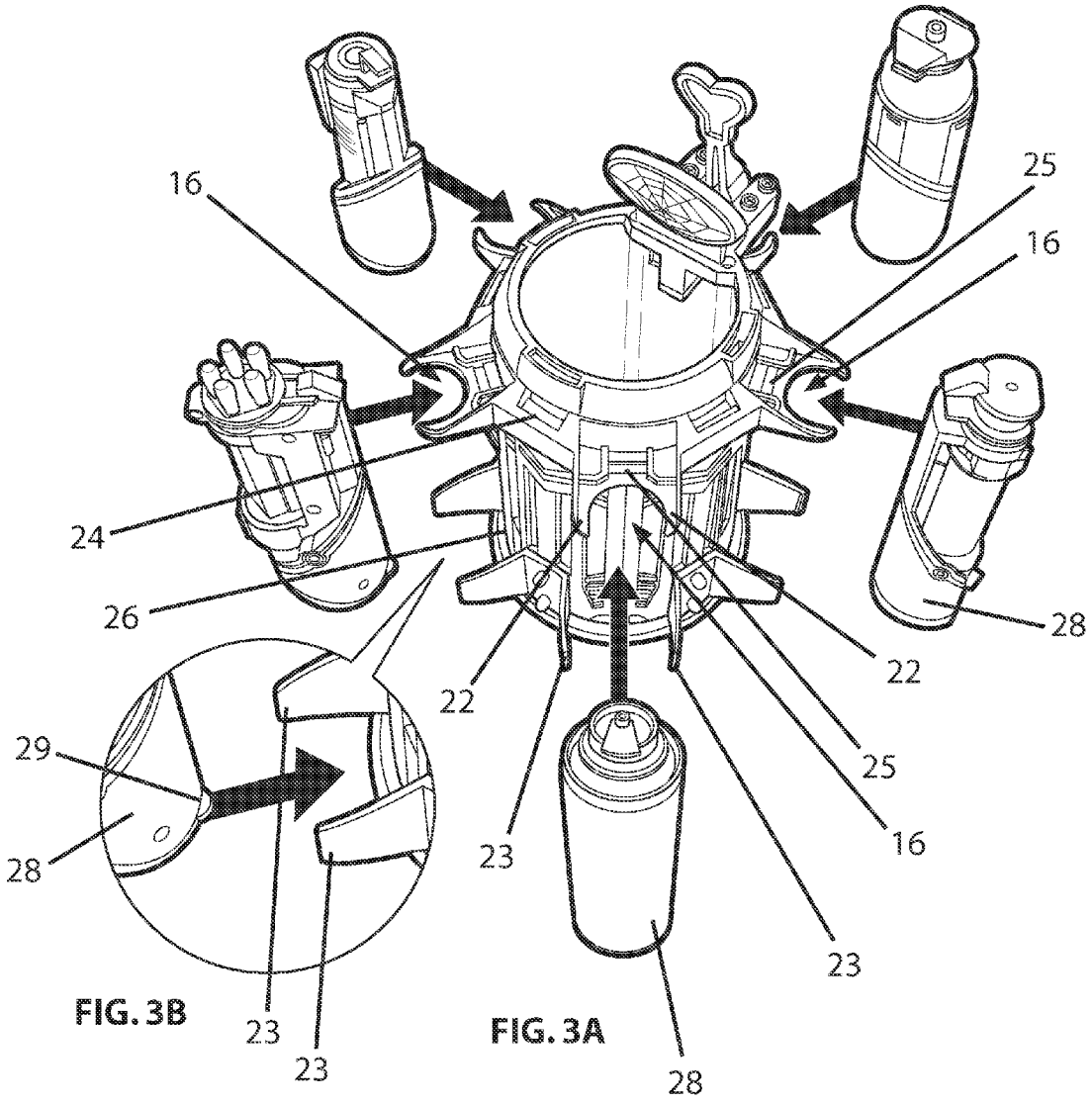
FIG. 3A illustrates a plurality of pods at the outer housing member each capable of receiving a canister, with FIG. 3B illustrating a canister coupling to a pod.

As seen in FIG. 3A, five pods 16 are spaced around the perimeter of the outer housing member 14. It is also contemplated that more or less than five pods can be included at the housing member 14 depending on the number and variety of discharge elements 18 which are desired. A removable canister 28, as seen in FIGS. 3A and 3B and discussed further below, is received in at least one of the plurality of pods 16 for containing the discharge element 18. In the present described embodiment, each removable canister 28 snaps into place at each holding clip 25 and the canister 28 may further include a tab 29 capable of snapping into place on the housing 14 to further secure the removable canister 28.

Figure 4A:
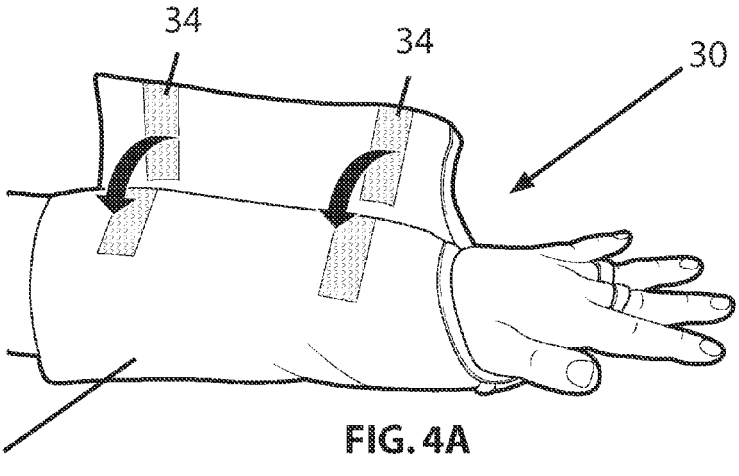
FIG. 4A illustrates a gauntlet worn by the user.
Figure 4B:
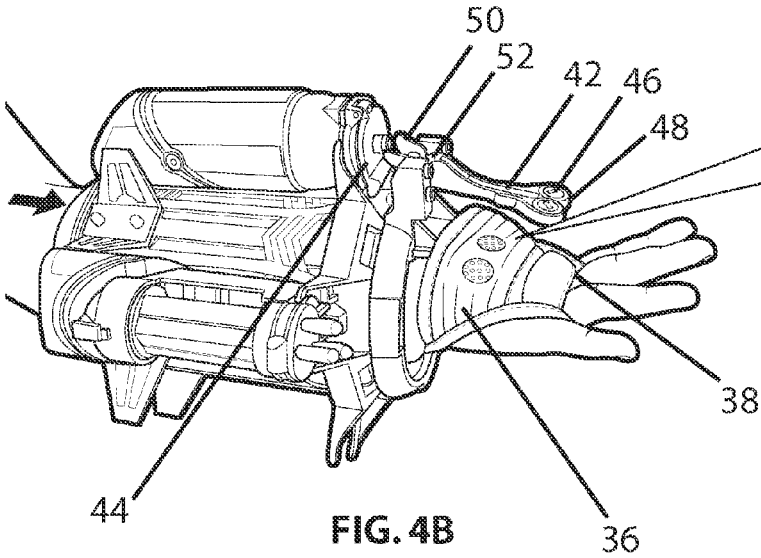
FIG. 4B illustrates a palm pad pocket of the gauntlet, with FIG. 4C illustrating the alignment of the actuator assembly on the user through the use of the palm pad pocket.
Figure 4C:
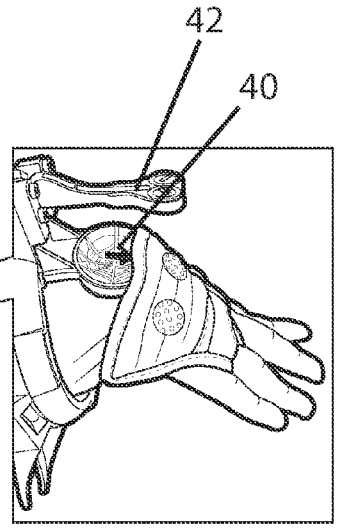
FIG. 4D illustrates the engagement between first and second actuators.

A covering 30, as seen in FIGS. 4A-4C is worn by the user to facilitate the alignment of the wearable component 12 on the forearm of the user. In the present described embodiment, a gauntlet 32 is secured on the forearm of the user with fastener straps 34, or an alternative fastening element, and positioned so that a palm pad pocket 36 of the gauntlet 32, seen in FIGS. 4B and 4C, is over the palm of the user. The gauntlet 32 further includes one or more finger loops 38 which slip onto one or more fingers of the user to further secure the gauntlet 32 in place.

A palm pad 40 coupled to or integral with the wearable component 12 slips into the palm pad pocket 36, as seen in FIG. 4C, positioning the actuator assembly 20 for activation by the user. As seen in FIG. 1B correct alignment of the actuator assembly 20 through the positioning of the gauntlet 32 allows the user to easily activate the assembly 20 and project the discharge element 18. The user can simply close one or more fingers toward the palm of his/her hand to depress the actuator assembly 20 and fire the discharge element 18, as seen in FIG. 1B.

Figure 4D:
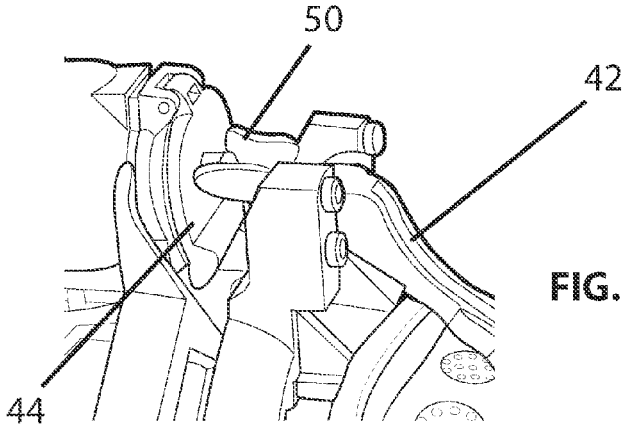

The actuator assembly 20 includes a first actuator 42 coupled to the wearable component 12, as best seen in FIG. 2, for manipulation by a user and a second actuator 44, seen in FIGS. 4B & 4D, capable of engaging the first actuator 42 for projecting the contained discharge element 18. The actuator assembly 20 is also capable rotating multiple projectiles of a contained discharge element into firing position, and pressurizing a contained fluid discharge element for firing of the fluid, through the same activation of the first actuator manipulated by the user, and discussed in more detail below.

The first actuator 42, as seen in FIG. 4B, includes a finger grip 46 at a first end 48, and a contact tab 50 at a second end 52. It is also contemplated that the second end 52 may be slightly enlarged or include a protuberance, or alternatively the first actuator 42 is large enough on its own for engagement with the second actuator 44. In the present described embodiment, the user engages the finger grip 46 with one or more middle fingers and depresses the first actuator toward his/her palm causing the contact tab 50 to engage the second actuator 44 projecting the contained discharge element 18.

The second actuator 44 is coupled to or integral with the removable canister 28, as seen in FIG. 4B. The removable canisters 28, as seen in FIGS. 6A-6E, are generally cylindrical in shape and include one or more discharge ports 56 and/or discharge connectors 58 in mechanical engagement with the second actuator 44. The second actuator 44 includes a discharge face 60 integral with or coupled to the canister 28 for engagement with the contact tab 50 of the first actuator 42. In the present described embodiment, the second actuator 44 includes a plate 62, gear 63, and/or a tab 64, depending on the type of discharge element contained in the canister 28, forming the discharge face 60 for engagement with the contact tab 50 of the first actuator 42.

Figure 5:
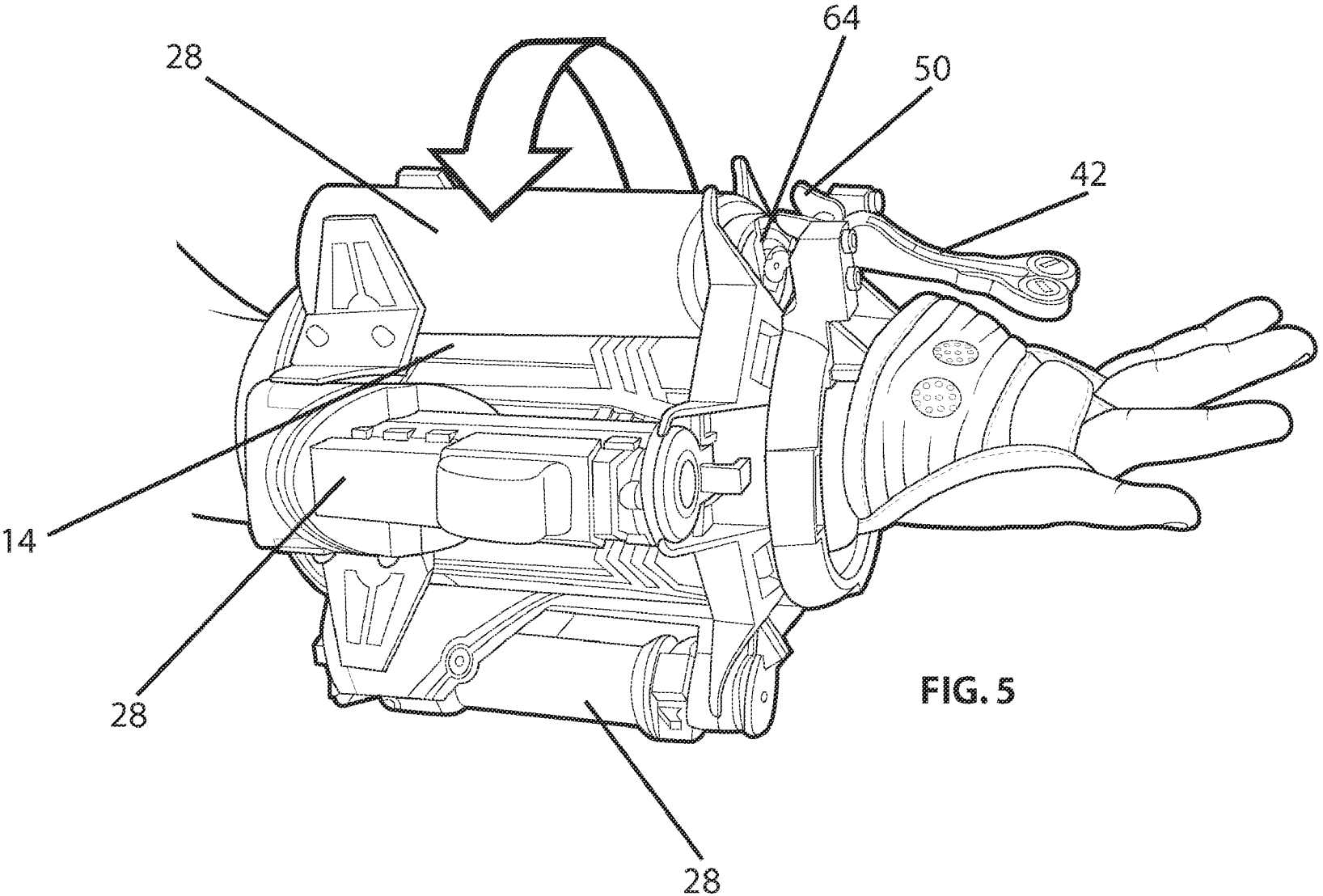
FIG. 5 illustrates the rotation of the outer housing member about the wearable component.

The outer housing member 14 is rotatable about the wearable component 12 either manually, or automatically driven by a further included motor. In the present described embodiment, as seen in FIG. 5, the outer housing member 14 rotates about the wearable component and first actuator 42, allowing separate alignment of each received removable canister 28 with the first actuator 42.

In the present described embodiment, as the user rotates the housing 14 about the wearable cylinder 12, each pod 16 will consecutively snap into alignment with the first actuator 42 which further aligns the received removable canister for engagement with the first actuator 42. Further, depressing the first actuator 42 activates the contact tab 50 to move the plate 62, gear 63, or tab 64 (depending on which is included in the specific aligned canister) toward the canister and project the contained discharge element 18. Each pod 16 is alternately rotated into alignment with the first actuator 42 enabling the user to launch the multiple discharge elements contained in each received canister 28 by simply pressing the same first actuator 42. It is also contemplated that the second actuator is pulled out rather than or in addition to being pushed in to pump the canister, for example when projecting water, as well as for projecting the discharge element.

Alternatively, as mentioned above, a motor can drive rotation of the housing member 14 about the wearable component 12 and first actuator 42. In this configuration, activation of the first actuator not only projects the contained discharge element within each of the received cartridges at each pod 16, but also rotates the outer housing member 14 about the wearable component 12. The first actuator 42 can be divided into a projecting first actuator (configured to project each discharge element as described above) and a rotation first actuator mechanically engaged with the motor for rotating the housing 14 to align the projecting first actuator with each pod 16 in the same manner as described above. It is also contemplated that the first actuator may be pulled rather than pushed in to either project the contained discharge element and/or to rotate the outer housing member, for example to first pump a canister of water before projecting it.

The discharge element 18 includes one or more of a fluid, a projectile, and a light emitting element, etc, contained within a corresponding removable canister 28 tailored to load a specific type of discharge elements 18, as seen in FIGS. 6A-6E. A light emitting element can include a flashlight type device or a more sophisticated laser type device receivable in a pod 16.

Figure 6A:
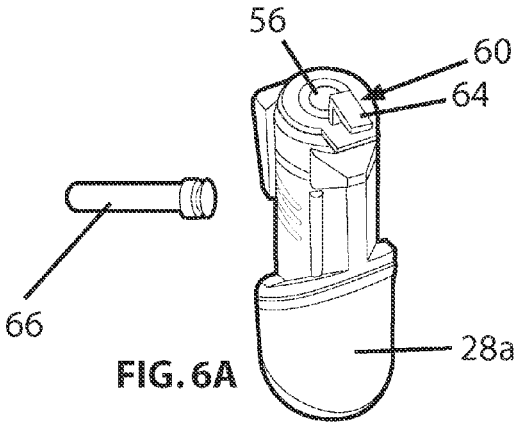
FIGS. 6A-6E illustrate discharge elements and their corresponding canisters.

A suction dart 66, as seen in FIG. 6A loads into the port 56 of canister 28*a* which is received into a pod 16, as shown in FIG. 1A. Canister 28*a* includes a blaster 68 which is cocked by sliding the blaster down the canister away from the port 56 after loading the dart 66. Depressing the first actuator 42, as seen in FIG. 1B, causes contact tab 50 to press tab 64 toward canister 28*a* launching the dart 66.

Figure 6B:
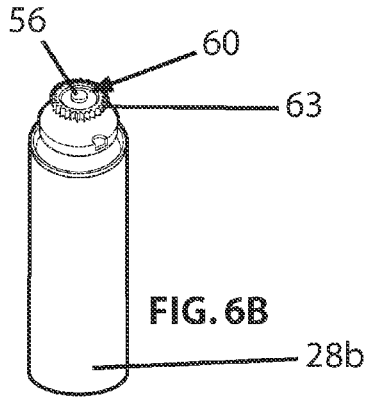
Figure 7A:
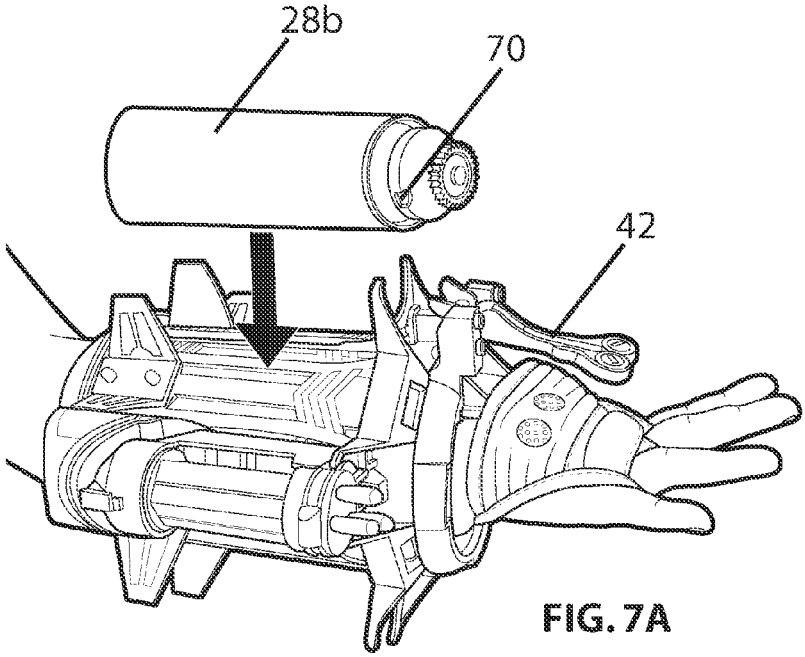
FIG. 7A illustrates loading a canister containing a fluid projectile onto a pod at the housing and FIG. 7B illustrates projecting the fluid by activating the actuator assembly.
Figure 7B:
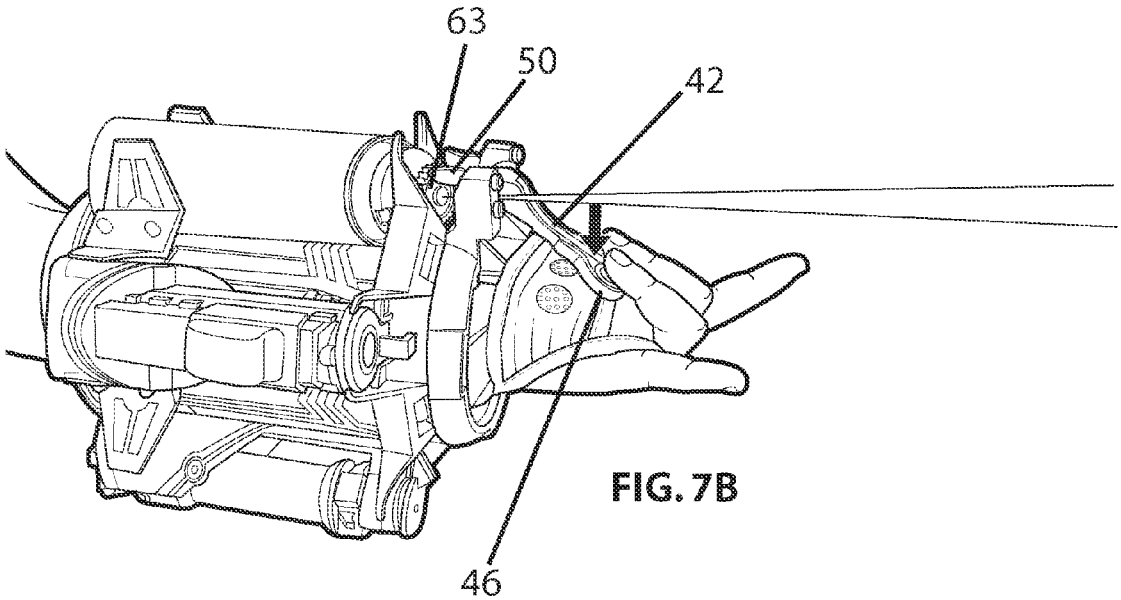

Another discharge element includes a viscous fluid similar to silly string loaded into canister 28*b*, as seen in FIG. 6B, and received into a pod 16, as shown in FIGS. 7A and 7B. Canister 28*b* may be pressurized to aid in the projection of the viscous fluid, and also include an indicator 70 to aid in properly opening and aligning the canister 28*b* at the housing 14. Depressing the first actuator 42, as seen in FIG. 7B, causes contact tab 50 to press gear 63 toward canister 28*b* projecting the viscous fluid.

Figure 6C:
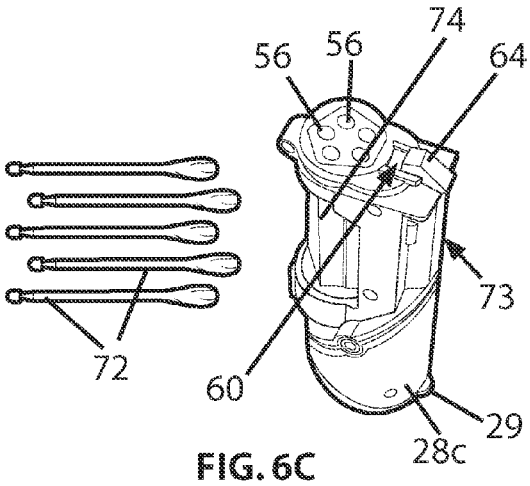

Another discharge element includes multiple missile projectiles 72, as seen in FIG. 6C, and received into the multiple ports 56 of canister 28*c*. Canister 28*c* further includes a rotatable member 73 coupled to canister 28*c* capable of receiving multiple projectiles and mechanically engaged with the first actuator 42. In the present described embodiment a rotatable missile blaster 74 for receiving five missiles will advance automatically to fire all five missiles 72 as the actuator assembly 20 is activated. It is also contemplated that the missile blaster 74 can receive more or less than five missile projectiles 72.

Figure 8A:
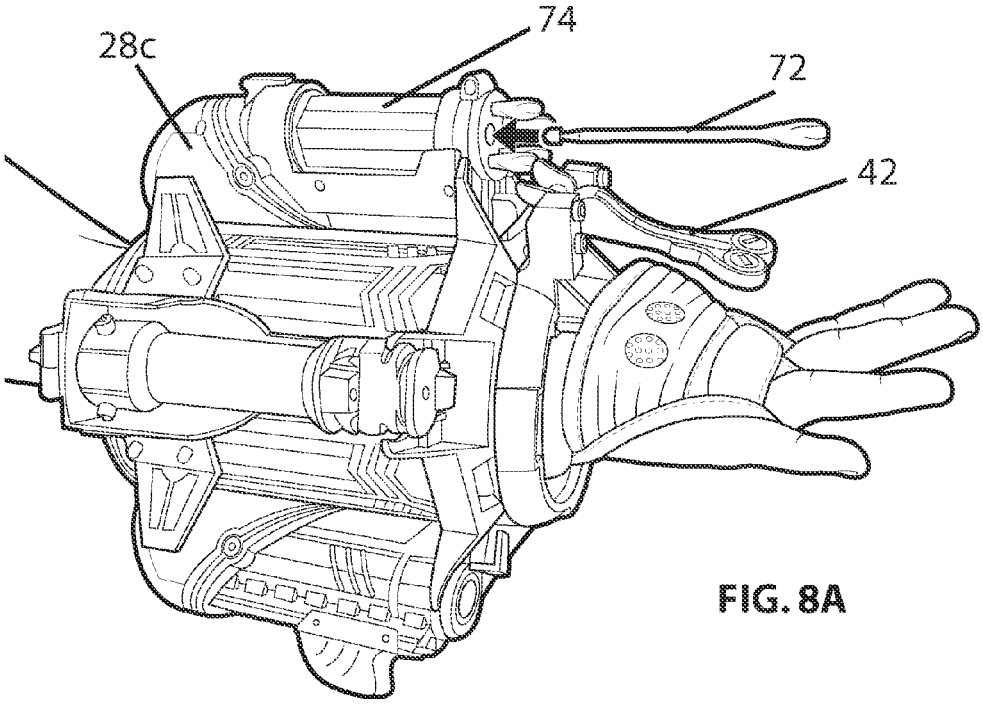
FIG. 8A illustrates loading a canister containing multiple missile projectiles onto a pod at the housing and FIG. 8B illustrates activating the actuator assembly to project the multiple missile projectiles.
Figure 8B:
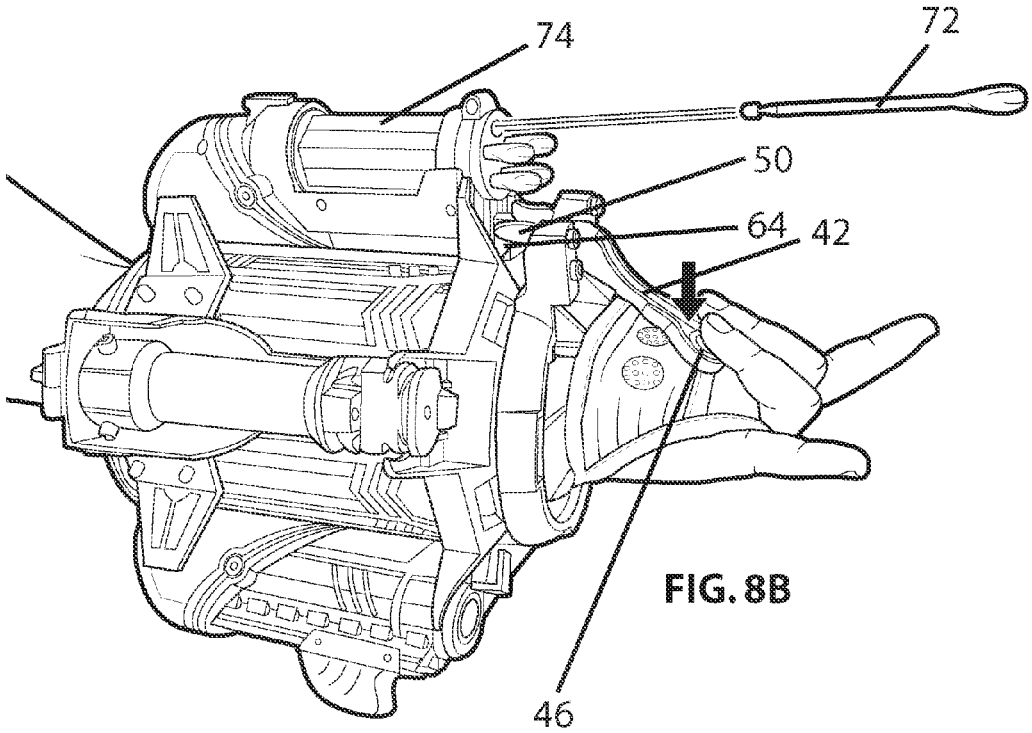

As seen in FIG. 8A, canister 28*c* with loaded missiles 72 is loaded onto a pod at the housing 14. In the present described embodiment, depressing the first actuator 42 rotates a projectile 72 received in the blaster 74 into firing position and fires the received projectile 72. Depressing the first actuator 42, as seen in FIG. 8B, causes contact tab 50 to press tab 64 toward canister 28*c* projecting the missile 72. The user will depress the first actuator 42 each time the firing of a missile is desired and the blaster 74 will automatically rotate the next available missile 72 into firing position. For example, to fire all five of the missiles 72, in the present described embodiment, the user will simply depress the first actuator 42 five times.

Figure 6D:
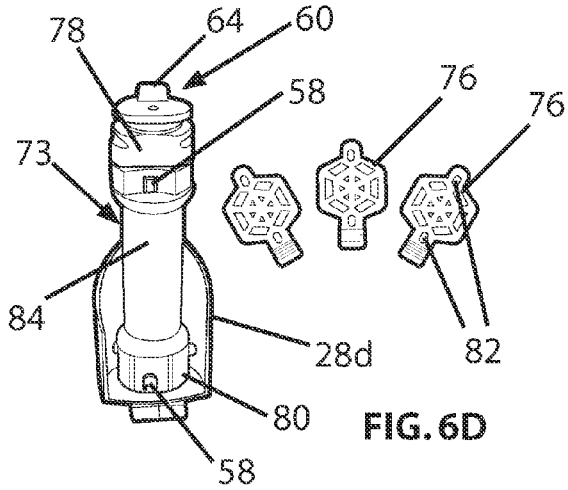
Figure 9A:
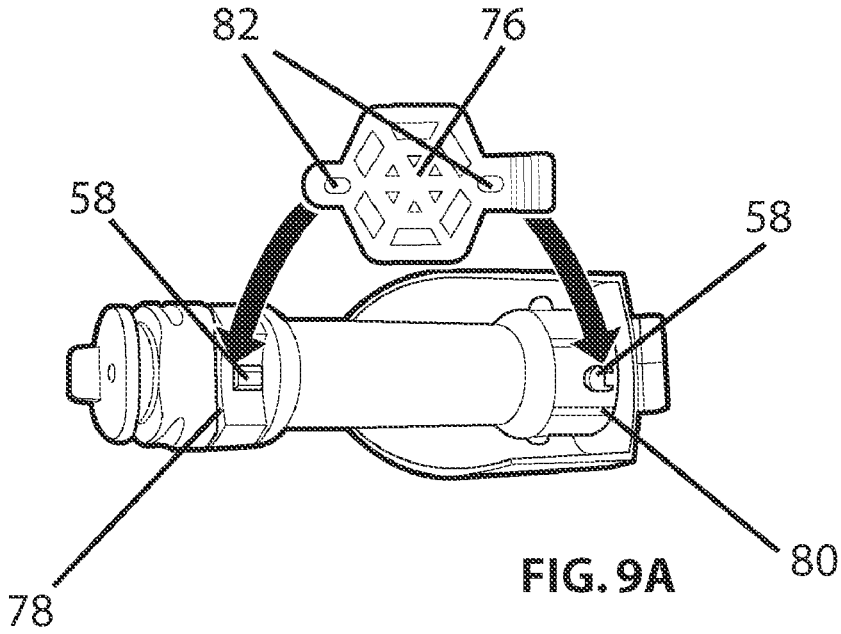
FIG. 9A illustrates loading a web projectile onto a corresponding canister and FIG. 9B illustrates activating the actuator assembly to project the web projectile.

Another discharge element includes multiple stretchy web projectiles 76, as seen in FIG. 6D, and loaded onto canister 28*d*. Canister 28*d* includes at least one discharge connector 58 at both first and second ends, 78 and 80 respectively, of the cylindrical canister 28*d* for loading the stretchy web projectile 76. As seen in FIG. 9A, each web projectile 76 includes at least two loops 82 for connecting to the discharge connectors 58.

In the present described embodiment, each web projectile 76 is stretched to hook two loops 82 over a pair of discharge connectors 58 disposed at first 78 and second 80 ends of the canister 28*d*, as seen in FIG. 9A. The canister includes three pairs of discharge connectors 58 spaced around the perimeter of the canister 28*d* for holding three stretchy web projectiles 76. Canister 28*d* further includes a rotatable member 73 coupled to canister 28*d* capable of receiving multiple projectiles and mechanically engaged with the first actuator 42. In the present described embodiment a rotatable web blaster 84 for receiving three web projectiles 76 operates to automatically advance each web projectile into a firing position. It is contemplated that more or less than three web projectiles 76 are included, as well as having multiple webs launched from the same pair of discharge connectors, rather than each web launched from its own pair of discharge connectors.

Figure 9B:
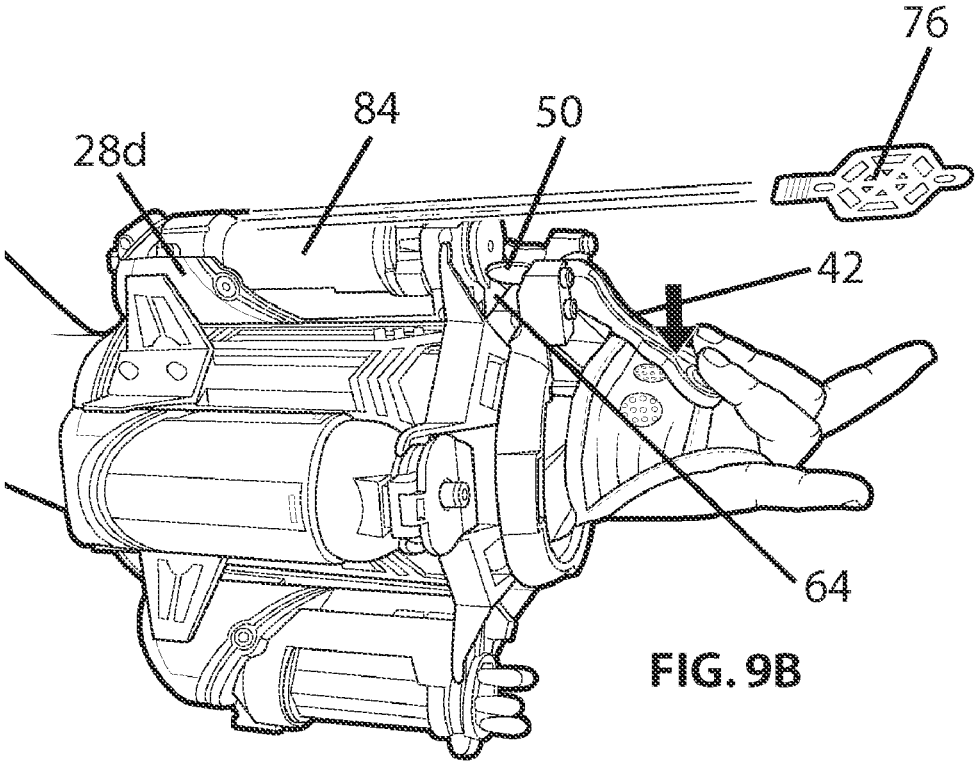

In the present described embodiment, depressing the first actuator 42 rotates a projectile 76 received in the web blaster 84 into firing position and fires the received projectile 76. Depressing the first actuator 42, as seen in FIG. 9B, causes contact tab 50 to pull tab 64 downward toward the housing 14 lowering the discharge connector 58 at the second end 80 of the canister 28*d* and launching the web projectile 76. The user will depress the first actuator 42 each time the firing of a web projectile 76 is desired and the blaster 84 will automatically rotate the next available web 76 into firing position. For example, to fire all three of the web projectiles 76, in the present described embodiment, the user will simply depress the first actuator 42 three times.

Figure 6E:
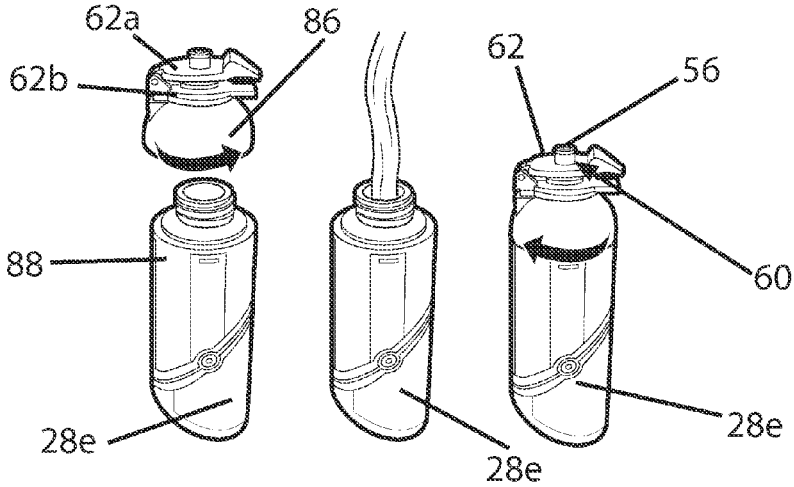

Another discharge element includes a water projectile loaded into canister 28*e*, as seen in FIG. 6E. Canister 28*e* includes a hinged cap 86 threaded to screw onto a first end 88 of canister 28*e* enabling a user to fill and refill the canister 28*e* with water. Canister 28*e* may further include a resilient expandable member or bladder to exert pressure on the contained water and facilitate the firing of a stream of water from canister 28*e*.

Figure 10B:
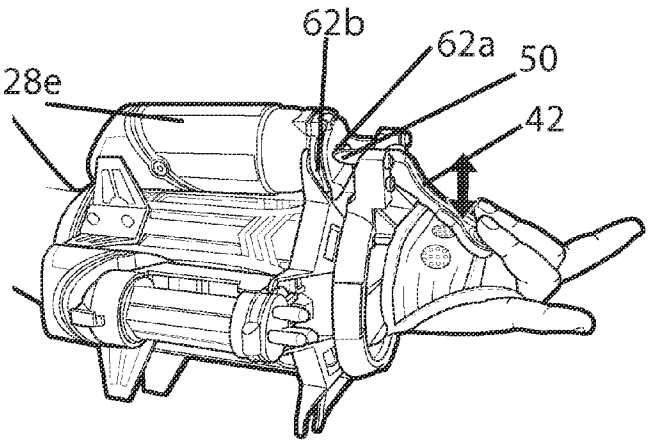
FIGS. 10A-10C illustrate the process of loading a canister containing water projectile onto a pod at the housing and projecting the water by activating the actuator assembly.
Figure 10A:
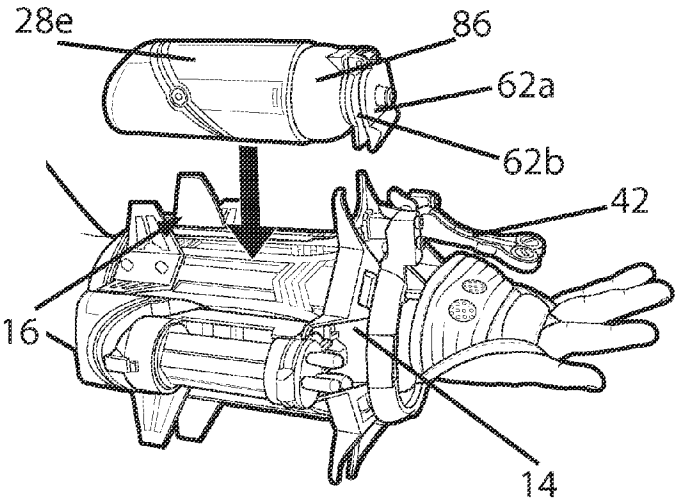
Figure 10C:
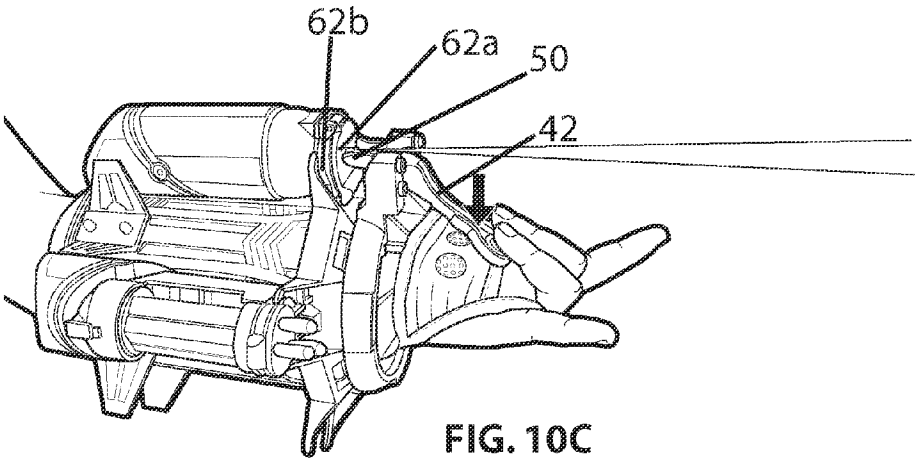

Once filled with water, canister 28*e* is received into pod 16 at the housing 14, as seen in FIGS. 10A-10C. Hinged cap 86 includes first plate 62*a* and second plate 62*b* hinged together to enable air to be pumped into canister 28*e* pressurizing the canister 28*e* and facilitate the firing of a steady stream of water. Repeatedly depressing first actuator 42, as seen in FIG. 10B, causes contact tab 50 to repeatedly press first plate 62*a* toward second plate 62*b* and pump air into canister 28*b*. In the present described embodiment, canister 28*e* is pumped approximately 15 times by depressing the first actuator 42 approximately 15 in a row, as seen in FIG. 10B. After canister 28*e* has been pumped, further depressing of the first actuator 42 will cause contact tab 50 to once again press first plate 62*a* toward second plate 62*b* and project the steady stream of water, as seen in FIG. 10C.

A method for projecting a discharge element from a plurality of pods includes the steps of providing a wearable component, rotatably coupling an outer housing member to the wearable component, and affixing a plurality of pods to the outer housing and containing a discharge element within each of the plurality of pods. Further, activating an actuator assembly capable of engaging each of the plurality of pods projects the contained discharge element.

The discharge element further provides one or more of the following: a fluid; a projectile; and a light emitting element, and the discharge element is further contained in a removable canister received in at least one of the plurality of pods. Additionally, the wearable component further provides a wearable cylinder. The method further includes providing a fluid in the canister and further including the steps of pumping the first actuator to pressurize the contained fluid.

The method further provides a rotatable member coupled to the canister capable of receiving multiple projectiles and mechanically engaged with the first actuator, and further includes the step of depressing the first actuator to both rotate the rotatable member positioning a received projectile in a firing position and also to fire the received projectile.

From the foregoing, it can be seen that there has been provided a unique wearable toy with a plurality of rotatable discharge pods for launching of a variety of projectiles by simply pressing a single lever one or more times. While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A toy having rotatable discharge pods, comprising:

a wearable component;

an outer housing member rotatable about the wearable component;

a plurality of pods at the outer housing, each of the plurality of pods being capable of receiving a discharge element contained therewith; and an actuator assembly for engagement with each of the plurality of pods for projecting the contained discharge element.

2. The toy according to claim 1, wherein the actuator assembly includes a first actuator coupled to the wearable component for manipulation by a user and a second actuator capable of engaging the first actuator for projecting the contained discharge element.

3. The toy according to claim 1, wherein the discharge element comprises one or more of the following: a fluid; a projectile; and a light emitting element.

4. The toy according to claim 1, wherein the wearable component comprises a wearable cylinder.

5. The toy according to claim 4, further comprising a covering worn by a user to facilitate the alignment of the cylinder on the forearm of the user.

6. The toy according to claim 1, wherein the outer housing member is manually rotatable about the wearable component.

7. The toy according to claim 2, further comprising a motor to drive the rotation of the outer housing member about the wearable component.

8. The toy according to claim 7, wherein the first actuator projects the contained discharge element within each of the plurality of pods and rotates the outer housing member.

9. The toy according to claim 2, further comprising a removable canister to contain the discharge element received in at least one of the plurality of pods.

10. The toy according to claim 9, wherein the second actuator is coupled to the removable canister and capable of engagement with the first actuator as the outer housing member is rotated to allow alignment of first and second actuators for projecting the discharge element contained in the canister.

11. A method for projecting a discharge element from a plurality of pods, comprising:

providing a wearable component;

rotatably coupling an outer housing member to the wearable component;

affixing a plurality of pods to the outer housing and containing a discharge element within each of the plurality of pods; and activating an actuator assembly capable of engaging each of the plurality of pods for projecting the contained discharge element.

12. The method according to claim 11, wherein the actuator assembly further provides a first actuator coupled to the wearable component for manipulation by a user and a second actuator capable of engaging the first actuator for projecting the contained discharge element.

13. The method according to claim 11, wherein the wearable component further provides a wearable cylinder.

14. The method according to claim 11, wherein the discharge element comprises one or more of the following: a fluid; a projectile; and a light emitting element.

15. The method according to claim 12, containing the discharge element in a removable canister received in at least one of the plurality of pods.

16. The method according to claim 15, providing a fluid in the canister and further comprising the steps of pumping the first actuator to pressurize the contained fluid.

17. The method according to claim 15, further providing a rotatable member coupled to the canister capable of receiving multiple projectiles and mechanically engaged with the first actuator, and further comprising the step of depressing the first actuator to rotate a received projectile into firing position and to fire the received projectile.

18. A toy having rotatable discharge pods, comprising:

a wearable component;

an outer housing member rotatable about the wearable component;

a plurality of pods at the outer housing, each of the plurality of pods being capable of receiving a discharge element contained therewith;

a removable canister containing the discharge element received in at least one of the plurality of pods; and an actuator assembly including a first actuator coupled to the wearable component for manipulation by a user and a second actuator capable of engaging the first actuator projecting the contained discharge element of each of the plurality of pods, wherein the canister includes a second actuator coupled thereto and capable of engagement with the first actuator as the outer housing member is rotated to allow alignment of first and second actuators for projecting the discharge element contained in the canister.

19. The toy according to claim 18, wherein the discharge element comprises one or more of the following: a fluid; a projectile; and a light emitting element.

20. The toy according to claim 18, wherein the wearable component comprises a wearable cylinder.

* * * * *